US008758563B2

(12) United States Patent
Jaffee et al.

(10) Patent No.: US 8,758,563 B2
(45) **Date of Patent: *Jun. 24, 2014**

(54) METHOD OF MAKING TOUGH, FLEXIBLE MATS

(75) Inventors: Alan Michael Jaffee, Bowling Green, OH (US); Richard Emil Kajander, Toledo, OH (US)

(73) Assignee: Johns Manville, Denver, CO (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/599,142

(22) Filed: Aug. 30, 2012

(65) Prior Publication Data

US 2012/0321807 A1 Dec. 20, 2012

Related U.S. Application Data

(62) Division of application No. 10/718,007, filed on Nov. 20, 2003, now Pat. No. 8,283,266, and a division of application No. 11/820,353, filed on Jun. 19, 2007, now Pat. No. 7,547,375.

(51) Int. Cl.

| | |
|---|---|
| ***D21H 13/40*** | (2006.01) |
| ***D21H 13/24*** | (2006.01) |
| ***D21H 13/10*** | (2006.01) |
| ***D21H 13/26*** | (2006.01) |
| ***D21H 17/37*** | (2006.01) |
| ***D21H 21/18*** | (2006.01) |

(52) U.S. Cl.

CPC ..... *D21H 13/40* (2013.01); *D21H 13/24* (2013.01); *D21H 13/10* (2013.01); *D21H 13/26* (2013.01); *D21H 17/37* (2013.01); *D21H 21/18* (2013.01)

USPC ..... 162/145; 162/135; 162/141; 162/146; 162/164.6; 162/168.2

(58) Field of Classification Search

CPC ..... D21H 13/40; D21H 13/24; D21H 17/37; D21H 13/10; D21H 13/26; D21H 21/18

USPC ..... 162/135–136, 141, 144, 146, 148–149, 162/152, 156, 157.1, 157.3, 158, 159, 162/164.1, 168.1, 168.2, 166, 169, 145; 442/172, 176–177, 180, 342, 415; 428/340

See application file for complete search history.

(56) References Cited

U.S. PATENT DOCUMENTS

| | | | | |
|---|---|---|---|---|
| 4,888,235 | A * | 12/1989 | Chenoweth et al. | 442/342 |
| 5,661,213 | A * | 8/1997 | Arkens et al. | 524/555 |
| 5,772,846 | A * | 6/1998 | Jaffee | 162/145 |
| 5,837,620 | A * | 11/1998 | Kajander | 442/63 |
| 7,547,375 | B2 * | 6/2009 | Jaffee et al. | 162/156 |
| 7,608,125 | B2 * | 10/2009 | Jaffee | 55/524 |
| 8,283,266 | B2 * | 10/2012 | Jaffee et al. | 442/172 |
| 2003/0109190 | A1 * | 6/2003 | Geel | 442/342 |
| 2005/0112374 | A1 * | 5/2005 | Jaffee et al. | 428/375 |
| 2005/0112978 | A1 * | 5/2005 | Jaffee et al. | 442/415 |
| 2007/0066698 | A1 * | 3/2007 | Yang et al. | 522/6 |
| 2007/0271890 | A1 * | 11/2007 | Jaffee | 55/527 |
| 2009/0163097 | A1 * | 6/2009 | Kajander | 442/118 |
| 2010/0273376 | A1 * | 10/2010 | Jaffee et al. | 442/17 |
| 2012/0321807 | A1 * | 12/2012 | Jaffee et al. | 427/389.9 |

FOREIGN PATENT DOCUMENTS

| | | | |
|---|---|---|---|
| EP | 378295 | A2 * | 7/1990 |
| EP | 990728 | A1 * | 4/2000 |
| EP | 1541763 | A2 * | 6/2005 |
| EP | 2251474 | A1 * | 11/2010 |

* cited by examiner

*Primary Examiner* — Jose Fortuna

(74) *Attorney, Agent, or Firm* — Robert D. Touslee

(57) ABSTRACT

A method of making a nonwoven fibrous mat that retains good strength and recovery after scoring and folding, properties making the mat useful in making collapsible ceiling tile. The mat comprises a majority of glass fibers and a minority of polymer fibers, the fibers being bound together with up to 35 wt. percent of a polyacrylic acid and polyol polymer binder based on the dry weight of the mat. The mat can be cured to "B stage", thermoformed into the desired shape and then heated further to complete the cure of the binder.

54 Claims, No Drawings

METHOD OF MAKING TOUGH, FLEXIBLE MATS

This application is a division of patent application Ser. No. 10/718,007 filed on Nov. 20, 2003, now U.S. Pat. No. 8,283,266 issued on Oct. 9, 2012, and also application Ser. No. 11/820,353 filed on Jun. 19, 2007, now U.S. Pat. No. 7,547,375 issued Jun. 16, 2009.

The present invention relates to methods of making fibrous, nonwoven mats for use in ceiling panel fabrication and other applications where similar requirements exist and the mats so made.

BACKGROUND

Ceiling panels are commonly used to form the ceiling of a building and can be made from a variety of materials including mineral fibers, cellulosic fibers, fiberglass, wood, metal and plastic. It is typically beneficial for such ceiling panels to have good structural properties such as stiffness and resiliency, as well as flame resistance characteristics. For some applications, it can also be beneficial for the ceiling panel to have acoustic absorption properties.

It would be advantageous to provide a ceiling panel which possesses excellent structural, flame resistance and acoustic absorption properties and in addition, very light weight. It would be even further advantageous, to aid shipping and storing costs, if the ceiling panels were able to be compressed to a fraction of their normal size for packaging, and then would spring back to normal size for installation and service. Such a ceiling panel has been designed by others utilizing fibrous, nonwoven mat, see published U.S. Patent Application No. 20020020142 filed Apr. 23, 2001. Unfortunately, conventional fibrous nonwoven mats have failed to meet all of the requirements of this design, which are to be able to, after being scored, folded, and compressed, to spring back to the original shape and orientation, and also to avoid giving off toxic gases when subjected to fire. Johns Manville's DURAGLAS™ 8802 mat, an acrylic bonded, wet laid, blend of glass fiber polyester, mat failed to perform satisfactorily in this ceiling tile because of excessive flammability and excessive sag at ambient temperatures. The present invention overcomes these problems and fills this need for a suitable mat for making ceiling tile according to the above mentioned U.S. Published Patent Application.

SUMMARY OF THE INVENTION

The present invention comprises a method of making a fibrous nonwoven mat having unique flex and recovery properties, particularly after scoring and folding. The method comprises;

a) dispersing fibers to produce a dispersion, the dispersion comprising glass fibers and man-made polymer fibers,
b) subjecting the dispersion to a moving permeable forming belt to form a fibrous web,
c) applying an aqueous resin binder to the wet web and removing any excess binder to produce the desired binder content in the wet web, and
d) drying the wet web and curing the resin in the binder to form a resin bound fibrous non woven mat, the improvement comprising:
e) i) the fiber dispersion comprising about 2 to about 35 weight percent polyester fibers and about 98 to about 65 weight percent glass fibers, and ii) using as the aqueous binder a mixture comprised of water and a resin formed from a homopolymer or a copolymer of polyacrylic acid and a polyol.

The ratio of glass fibers to polyester fibers can be as shown above, and is preferred to be about 5 to about 20 wt. percent of polyester fibers to about 95 to about 80 wt. percent of glass fibers and most preferably about 8 to about 16 wt. percent polyester fibers and about 92 to about 84 wt. percent glass fibers. The binder content can vary up to about 35 wt. percent of the finished dry mat and down to about 10 wt. percent with about 20 wt. percent being the most preferred, but binder contents in the range of 15-25 wt. percent being preferred. Fibrous non-woven mats containing a blend of glass fibers and polymer fibers as described above and bound with the cured binder and amounts described above are also included in the present invention. While it is preferred to form an aqueous dispersion of the fibers and form the web on a wet forming machine such as an inclined wire mat machine, dry laid machines and processes including continuous fiber strand forming processes can also be used to form the mats of the present invention.

The mats of the present invention comprise a blend of fibers comprising about 98 to about 65 wt. percent, preferably about 80 to about 95 weight percent and most preferably about 92 to about 84 wt. percent glass fibers and about 2 to about 35 wt. percent, preferably 5 to about 20 wt. percent and most preferably about 8 to about 16 wt. percent man-made polymer fibers in a nonwoven web, the fibers in the web being bound together by a cured binder that comprises before drying and curing a homopolymer or a copolymer of polyacrylic acid and a polyol. The amount of binder in the finished mat is preferably in the range of about 10 to about 35 wt. percent, based on the weight of the dry finished mat, more preferably within the range of about 15 to about 32 wt. percent and most preferably about 25+/−5 wt. percent. This mat also had excellent recovery after being scored and folded. It could be folded many times, held in a folded condition for extended periods and still would spring back to a vertical orientation in the web of the ceiling panel of the type disclosed in U.S. Published Patent Application No. 20020020142.

It has been discovered that the combination of using a blend of glass fibers and polymer fibers with the binder formed from a homopolymer or a copolymer of polyacrylic acid and a polyol produces a fibrous nonwoven mat having unexpected high tensile strength and recovery after scoring and folding, and also an unexpected high flame resistance considering the amount of oxygen in the binder. When making mats for use in the compressible ceiling panel mentioned above, it is preferred that the mats have a degree of cure, i.e. its wet tensile strength divided by its dry tensile strength multiplied by 100 that equals at least 35 percent, more preferably at least 40 percent. Mats of the present invention pass the National Fire Protection Association's (NFPA) Method #701 Flammability Test. Taber stiffness of these mats is greater than about 40 gram centimethers, preferably greater than about 50 and most preferably greater than about 55. Air permeability of the mats are preferably within the range of about 500 to about 700 CFM/sq. ft. When the term "substantially free of phenol formaldehyde and urea" is used it is meant that none, or so little, is present that the mats pass the NFPA Flammability Test.

By modifying the above method in the drying/curing step, a mat with different characteristics is produced. The modification is to drop the temperature in the oven such that the binder in the mat is cured to only a "B" stage condition. This can be achieved by heating the mat to only about 250 degrees F. in the oven. Mats made with this modification can be theromoformed to a desired shape, or pleated and then heated to complete the cure of the binder. The desired shape will then be retained in the mat. Such molded shapes can have many uses such as performs for SRIM and laminating processes, pleated filters and many other uses.

When the word "about" is used herein it is meant that the amount or condition it modifies can vary some beyond that so long as the advantages of the invention are realized. Practically, there is rarely the time or resources available to very precisely determine the limits of all the parameters of ones invention because to do would require an effort far greater than can be justified at the time the invention is being developed to a commercial reality. The skilled artisan understands this and expects that the disclosed results of the invention might extend, at least somewhat, beyond one or more of the limits disclosed. Later, having the benefit of the inventors disclosure and understanding the inventive concept and embodiments disclosed including the best mode known to the inventor, the inventor and others can, without inventive effort, explore beyond the limits disclosed to determine if the invention is realized beyond those limits and, when embodiments are found to be without any unexpected characteristics, those embodiments are within the meaning of the term "about" as used herein. It is not difficult for the artisan or others to determine whether such an embodiment is either as expected or, because of either a break in the continuity of results or one or more features that are significantly better than reported by the inventor, is surprising and thus an unobvious teaching leading to a further advance in the art.

DETAILED DESCRIPTION OF PREFERRED EMBODIMENTS

The inventive mat can be used in making ceiling panels, pleated filter products and other products requiring a fibrous mat having good resilience, recovery characteristics, flexibility, strength and integrity after being scored and folded. These mats contain about 65 to about 90 wt. percent fibers and about 10 to about 35 wt. percent binder. The fibers are a blend of polymer fibers and inorganic fibers such as glass or carbon fibers. The blend can be from about 2 to about 35 wt. percent polymer fibers and the inorganic fibers can be present in the fibrous web in amounts between about 98 wt. percent and 65 wt. percent, based on the weight of fibers in the mat. Preferably the polymer fibers, like polyester fibers, are present in amounts between about 5 and about 20 wt. percent, most preferably from about 8 to about 16 wt. percent such as about 12 wt. percent.

The polymer fibers are preferably polyester fibers, but can also be any polymer fiber such as polypropylene, nylon, PBT, polyacrynitrile, polybenzimidizole, and other known polymer fibers having similar resilience and a softening point high enough to tolerate the temperatures used in the mat manufacturing process and subsequent processes that the mats are used in. The preferred diameter of the polyester fibers is about 1.5 denier, but both the length and diameter can be varied so long as the aspect ratio, length to diameter, remains within a range suitable satisfactorily dispersing the fibers in an aqueous inorganic fiber slurry suitable for forming a web on an wet laid web forming machine, such as an inclined wire former such as a VOITH HYDROFORMER® or a SANDY HILL DELTAFORMER®. The preferred length of 1.5 denier polyester fibers is 0.25 inch.

The denier of the polyester fibers can range from about 0.8 to about 6 denier and the fiber length will often be changed depending on the denier to get good dispersion, as is well known. The man-made polymer fibers can, but need not be, longer as the denier is increased. If tangling and/or roping causing clumps or bundles during dispersion, the length of the man-made polymer fibers must be reduced to get good dispersion.

The inorganic fibers are preferably glass fibers and preferably one inch long 16 micron diameter E glass fibers having a chemical sizing thereon as is well known. One fiber product preferred for use in the present invention is M117, a wet chopped fiber product available from Johns Manville Corporation of Denver, Colo., but any type of glass fiber can be used in lengths and diameters suitable for the wet laid processes. Any type of stable glass fibers can be used, such as A, C, S, R, E and other types of glass fibers. Preferably the average fiber diameter of glass fibers will range from about 8 to about 20 microns with fiber length ranging from about 0.25 to about 1.5 inches, preferably from about 0.5 to about 1.25 and most preferably from about 0.7 to about 1.1 inches.

The fiber blend webs are bound together by use of an aqueous binder composition applied with a curtain coater, dip and squeeze, roller coat, or other known saturating method in a known manner and the resultant saturated wet bindered web laying on a supporting wire or screen is run over one or more vacuum boxes to remove enough binder to achieve the desired binder content in the mat. The binder level in the inventive mats can range from about 10 to about 35 wt. percent of the finished dry mat, preferably about 15 to about 30 wt. percent and most preferably from about 20 to about 30 wt. percent, such as about 25+/−3 wt. percent. The binder composition is curable by the application of heat, i.e., the binder composition is a thermosetting composition.

The binder composition includes a homopolymer or copolymer of polyacrylic acid. Preferably, the average molecular weight of the polyacrylic acid polymer is less than 10,000, more preferably less than 5,000, and most preferably about 3,000 or less, with about 2000 being preferred. Use of a low molecular weight polyacrylic acid polymer in a low-pH binder composition can result in a final product which exhibits excellent structural recovery and rigidity characteristics. The binder composition can also include at least one additional polycarboxy polymer such as, for example, a polycarboxy polymer disclosed in U.S. Pat. No. 6,331,350, the entire contents of which are incorporated by reference herein.

The binder composition also includes a polyol containing at least two hydroxyl groups. The polyol is preferably sufficiently nonvolatile such that it can substantially remain available for reaction with the polyacid in the composition during the heating and curing thereof. The polyol can be a compound with a molecular weight less than about 1,000 bearing at least two hydroxyl groups such as, for example, ethylene glycol, glycerol, pentaerythritol, trimethylol propane, sorbitol, sucrose, glucose, resorcinol, catechol, pyrogallol, glycollated ureas, 1,4-cyclohexane diol, diethanolamine, triethanolamine, and certain reactive polyols such as, for example, -hydroxyalkylamides such as, for example, bis[N,N-di(-hydroxyethyl)]adipamide, as can be prepared according to U.S. Pat. Nos. 6,331,350 and 4,076,917, incorporated herein by reference, the contents of which are incorporated by reference herein. The polyol can be an addition polymer containing at least two hydroxyl groups such as, for example, polyvinyl alcohol, partially hydrolyzed polyvinyl acetate and homopolymers or copolymers of hydroxyethyl (meth)acrylate, hydroxypropyl (meth)acrylate and the like. Most preferably, the polyol is triethanolamine (TEA).

The ratio of the number of equivalents of carboxy, anhydride, or salts thereof of the polyacid to the number of equivalents of hydroxyl in the polyol can be about 1/0.01 to about 1/3. Preferably, there is an excess of equivalents of carboxy, anhydride, or salts thereof of the polyacid to the equivalents of hydroxyl in the polyol of, for example, from about 1/0.4 to about 1/1, more preferably from about 1/0.6 to about 1/0.8, and most preferably from about 1/0.65 to about 1/0.75. A low ratio, for example, about 0.7:1, is preferred when combined with a low molecular weight polycarboxy polymer and a low pH binder.

The binder composition can also include a catalyst. Preferably, the catalyst is a phosphorus-containing accelerator which can be a compound with a molecular weight less than about 1000. For example, the catalyst can include an alkali metal polyphosphate, an alkali metal dihydrogen phosphate, a polyphosphoric acid, an alkyl phosphinic acid and mixtures thereof.

Additionally or alternatively, the catalyst can include an oligomer or polymer bearing phosphorous-containing groups such as, for example, addition polymers of acrylic and/or maleic acids formed in the presence of sodium hypophosphite, addition polymers prepared from ethylenically unsaturated monomers in the presence of phosphorous salt chain transfer agents or terminators, addition polymers containing acid-functional monomer residues such as, for example, copolymerized phosphoethyl methacrylate, and like phosphonic acid esters, and copolymerized vinyl sulfonic acid monomers, and their salts, and mixtures thereof.

The catalyst can be used in an amount of from about 1% to about 40%, by weight based on the combined weight of the polyacrylic acid polymer and the polyol. Preferably, the catalyst is used in an amount of from about 2.5% to about 10%, by weight based on the combined weight of the polyacrylic acid polymer and the polyol.

The binder composition can also contain treatment components such as, for example, emulsifiers, pigments, fillers, anti-migration aids, curing agents, coalescents, wetting agents, biocides, plasticizers, organosilanes, anti-foaming agents, colorants, waxes and anti-oxidants. The binder composition can be prepared by mixing together a polyacrylic acid polymer and a polyol. Mixing techniques known in the art can be used to accomplish such mixing.

Preferably, the pH of the binder composition is low, for example, about 3 or less, preferably about 2.5 or less, and most preferably about 2 or less. The pH of the binder can be adjusted by adding a suitable acid, such as sulfuric acid. Such low pH of the binder can provide processing advantages, while also providing a product which exhibits excellent recovery and rigidity properties. An example of the processing advantages include a reduction in cure temperature or time.

To increase the flame resistance of the ceiling panel, a flame retardant material can be employed. The flame retardant material can be incorporated into the ceiling panel by, for example, mixing it into the aqueous binder. Any flame retardant material that is suitable for use in a fibrous mat can be used including, for example, an organic phosphonate. Such an organic phosphonate is available from Rhodia located in Cranbury, N.J., under the tradename Antiblaze NT.

The glass and polyester fibers which form the base material can be formed into a structure suitable for use as a ceiling panel, such as a mat. Any suitable means for forming the fibers can be used. For example, the fibers can be formed by the processes described in U.S. Pat. Nos. 5,840,413, 5,772,846, 4,112,174, 4,681,802 and 4,810,576, the entire contents of which are incorporated by reference herein.

Preferably, a dilute aqueous slurry of the glass and polyester fibers can be formed and deposited onto an inclined moving screen forming wire to dewater the slurry and form a wet nonwoven fibrous mat. For example, a Hydroformer available from Voith-Sulzer located in Appleton, Wis., or a Deltaformer available from Valmet/Sandy Hill located in Glenns Falls, N.Y., can be used. Other similar wet mat machines can be used.

After forming the wet, uncured web, it is preferably transferred to a second moving screen running through a binder application station where the aqueous binder described above is applied to the mat. The binder can be applied to the structure by any suitable means including, for example, air or airless spraying, padding, saturating, roll coating, curtain coating, beater deposition, coagulation or dip and squeeze application.

The excess binder, if present, is removed to produce the desired binder level in the mat. The web is formed and the binder level controlled to produce a binder content in the finished dry mat as described above and to produce a dry mat product having a basis weight of between about 1.9 lbs./100 sq. ft. to about 2.65 lbs./100 sq. ft., preferably from about 2 lbs./100 sq. ft. to about 2.55 lbs./100 sq. ft. such as about 2.45+/−0.75 lbs./100 sq. ft. The wet mat is then preferably transferred to a moving oven belt which transports the wet mat through a drying and curing oven such as, for example, a through air, air float or air impingement oven. Prior to curing, the wet mat can be optionally slightly compressed, if desired, to give the finished product a predetermined thickness and surface finish.

In the oven, the bindered web can be heated to effect drying and/or curing forming a dry mat bonded with a cured binder. For example, heated air can be passed through the mat to remove the water and cure the binder. For example, the heat treatment can be around 400 F. or higher, but preferably the mat is at or near the hot air temperature for only a few seconds in the downstream end portion of the oven. The duration of the heat treatment can be any suitable period of time such as, for example, from about 3 seconds to 5 minutes or more, but normally takes less than 3 minutes, preferably less than 2 minutes and most preferably less than 1 minute. It is within the ordinary skill of the art, given the this disclosure, to vary the curing conditions to optimize or modify the mat to have the desired properties.

The drying and curing functions can be conducted in two or more distinct steps. For example, the binder composition can be first heated at a temperature and for a time sufficient to substantially dry but not to substantially cure the composition and then heated for a second time at a higher temperature and/or for a longer period of time to effect curing. Such a procedure, referred to as "B-staging," can be used to provide binder-treated nonwoven, for example, in roll form, which can at a later stage be cured, with or without forming or molding into a particular configuration, concurrent with the curing process.

The following examples are provided for illustrative purposes and are in no way intended to limit the scope of the present invention.

EXAMPLE 1

Fibers were dispersed in a conventional white water in a known manner to produce a slurry in which the fibers are present in the ratio of 90% by weight 1" long glass fibers (John Manville's M117 fiber) having an average fiber diameter of about 16 microns, and 10% ¼" 1.5d polyester fiber. A wet web was formed from the slurry using a Voith Hydroformer®. Thereafter, the wet web was saturated with a polyacrylic acid/polyol resin binder composition using a curtain coater and excess aqueous binder was removed to produce a binder content in the finished mat of about 25%, based on the weight of the finished dry mat. The binder composition is available from Rhom & Haas located in Philadelphia, Pa., under the tradename TSET™. The bindered mat was then subjected to a heat treatment at a peak temperature of 400 degrees F. for about 3 seconds to dry the mat and cure the binder. This mat had a basis weight of about 2.45 lbs./100 sq. ft. and the following properties:

Thickness—42+/−3 mils

Tensile Strength—Machine Direction—90+ lbs./3 in. width

Cross-machine Direction—60+ lbs./in. width

This mat performed satisfactorily as the scored and folded vertical webs spanning between the exposed mat and the backer mat in the manufacture of ceiling panels made according to U.S. Published Patent Application No. 20020020142. This mat had excellent recovery after being scored and folded. It could be folded many times, held in a folded condition for extended periods and still would spring back to a vertical orientation in the vertical webs of the ceiling panel mentioned above.

EXAMPLE 2

The same kinds of fibers were dispersed in a conventional white water in a known manner to produce a slurry in which the fibers were present in the ratio of 88% by weight 1 inch long E glass fibers having an average fiber diameter of about 16 microns, and 12% ¼" 1.5 d polyester fiber. A wet web was formed from the slurry using a Voith Hydroformer®. Thereafter, the wet web was saturated with TSET™, an aqueous polyacrylic acid/polyol resin binder composition, using a curtain coater and excess aqueous binder is removed to produce a binder content in the finished mat of about 28%, based on the weight of the finished dry mat. The bindered mat was then subjected to a heat treatment at a peak temperature of 170 degrees C. for 5-15 seconds to dry the mat and cure the binder. This mat had a basis weight of about 2.60 lbs./100 sq. ft. and the following properties:

Thickness—43+/−5 mils

Tensile Strength Machine Direction—90+ lbs./3 in. width

Cross-machine Direction—60+ lbs./3 in. width

This mat performed satisfactorily as the scored and folded vertical webs spanning between the exposed mat and the backer mat in the manufacture of ceiling panels made according to U.S. Published Patent Application No. 20020020142. This mat had excellent recovery after being scored and folded. It could be folded many times, held in a folded condition for extended periods and still would spring back to a vertical orientation in the vertical webs of the ceiling panel mentioned above.

EXAMPLE 3

The same kinds of fibers were dispersed in a conventional white water in a known manner to produce a slurry in which the fibers were present in the ratio of 92% by weight of 1 inch long glass fibers having an average fiber diameter of about 16 microns, and 8% ¼" 1.5d polyester fiber. A wet web was formed from the slurry using a Voith Hydroformer®. Thereafter, the wet web is saturated with TSET™, an aqueous polyacrylic acid/polyol resin binder composition, using a curtain coater and excess aqueous binder was removed to produce a binder content in the finished mat of about 28%, based on the weight of the finished dry mat. The bindered mat was then subjected to a heat treatment at a peak temperature of about 400 degrees F. for about 3 seconds to dry the mat and cure the binder. This mat had a basis weight of about 2.30 lbs./100 sq. ft. and the following properties:

Thickness—40+/−5 mils

Tensile Strength Machine Direction—90+ lbs./3 in. width

Cross-machine Direction—60+ lbs./3 in. width

This mat performed satisfactorily as the scored and folded vertical webs spanning between the exposed mat and the backer mat in the manufacture of ceiling panels made according to U.S. Published Patent Application No. 20020020142. This mat had excellent recovery after being scored and folded. It could be folded many times, held in a folded condition for extended periods and still would spring back to a vertical orientation in the vertical webs of the ceiling panel mentioned above. The mats of the present invention also have unexpectedly high flame resistance in view of the oxygen content of the binder used in these mats. These mats pass the flammability test of NFPA.

By modifying the above method in the drying/curing step, a mat with different characteristics is produced. The modification is to drop the temperature in the oven such that the binder in the mat is cured to only a "B" stage condition. This can be achieved by heating the mat to only about 250 degrees F. in the oven. The time at lower maximum temperature can be varied, but typical time is about 30 seconds. Mats made with this modification can be theromoformed to a desired shape, or pleated and then heated to complete the cure of the binder. The desired shape will then be retained in the mat. Such molded shapes can have many uses such as performs for SRIM and laminating processes, pleated filters and many other uses.

While the invention has been described with preferred embodiments, it is to be understood that variations and modifications can be resorted to as will be apparent to those skilled in the art. Just for the purposes of illustration of variations included in the present invention, carbon black can be incorporated into the binder to affect color as can titania particles if a white mat is desired. Also, fire retardants can be incorporated into the aqueous binder composition such as organic phosphates like ANTI-BLAZE™ NT from Rhodia of Cranburry, N.J. Such variations and modifications are to be considered within the purview and the scope of the claims appended hereto.

The invention claimed is:

1. A method for making a fibrous nonwoven mat facer suitable as a backer mat, connector sheet, in a compressible ceiling panel of the type described in U.S. Published Patent Application No. 20020002142, filed Apr. 23, 2001, comprising;

a) dispersing fibers comprising two different types of fibers in a fluid dispersion, the fibers comprising 65-95 wt. percent glass fibers having an average diameter in the range of about 13 to about 17.5 microns and a length in the range of about 0.7 to about 1.1 inches, and about 5 to about 35 wt. percent man-made polymer fibers selected from a group consisting of polyester, polypropylene, nylon, PBT, polyacrynitrile and polybenzimidizole, b) subjecting the dispersion to a moving forming screen to form a fibrous web, c) applying an aqueous resin binder to the web, the binder comprised of polyacrylic acid homopolymer and a polyol having an average molecular weight of 3000 or less, the amount of binder applied amounting to a range of about 10 to about 35 wt. percent of the dried mat, and d) drying the wet web and at least partially curing the resin in the binder to form a resin bound fibrous nonwoven mat, wherein;

i) the fibrous nonwoven mat having a basis weight of about 2.3 to about 2.6 pounds per 100 square feet, a thickness of about 42+/−3 mils, a wet tensile strength of at least 35 percent of the dry tensile strength, a Tabor stiffness of at least about 40, an air permeability in the range of about 500 to about 800 CFM/sq. ft and passing the flammability test of NFPA, Method #701.

2. The method according to claim 1, wherein the binder is substantially free of phenol, formaldehyde and urea and wherein the tensile strength in the cross machine direction of the mat is about 60 lbs. per 3 inch width of the mat.

3. The method according to claim 2, wherein the polyol is triethanolamine.

4. The method according to claim 1, wherein the average molecular weight of the polyacrylic acid polymer is about 2,000 or less.

5. The method according to claim 4, wherein the polyol is triethanolamine.

6. The method according to claim 4, wherein the polyol is triethanolamine and the dispersion comprises a blend of about 8 to about 20 wt. percent polymer fibers and about 92 to about 80 wt. percent glass fibers, based on the total weight of the fibers in the dispersion.

7. The method according to claim 6 wherein the polymer fibers are polyester fibers.

8. The method according to claim 7 wherein the polyester fibers are 1.5 denier and at least about 0.25 inch long.

9. The method according to claim 8 wherein the binder content in the finished dry mat is within the range of about 15 to about 30 wt. percent.

10. The method of claim 9 wherein the binder content is within the range of about 15 to about 20 wt. percent.

11. The method according to claim 9 wherein the binder content is within the range of about 20 to about 30 wt. percent.

12. The method according to claim 11, wherein the binder further comprises a phosphorus-containing catalyst.

13. The method according to claim 11 wherein the blend comprises about 8 to about 16 wt. percent polyester fibers and about 84 to about 92 wt. percent glass fibers.

14. The method according to claim 11 wherein the blend comprises about 8 to about 12 wt. percent polyester fibers having a length of about 0.25 inch and about 88 to about 92 wt. percent glass fibers having an average diameter of about 16 microns.

15. The method according to claim 1, wherein the polyol is triethanolamine.

16. A method for making a fibrous nonwoven mat facer suitable as a backer mat, connector sheet, in a compressible ceiling panel of the type described in U.S. Published Patent Application No. 20020002142, filed Apr. 23, 2001, comprising;

a) dispersing fibers comprising polyester fibers and glass fibers in an aqueous mixture to form a dispersion, b) draining said mixture through a moving forming screen to form a wet fibrous web, c) applying an aqueous resin binder to the wet web and removing excess binder to produce the desired binder content in the wet web, and d) drying the wet web and at least partially curing the resin in the binder to form a resin bound fibrous nonwoven mat, wherein;

i) the dispersion comprises about 5 to about 20 weight percent man-made polyester fibers and about 95 to about 80 weight percent glass fibers having an average fiber diameter in the range of about 13 to about 17.5 microns, based on the total weight of fibers in the dispersion, ii) the aqueous binder comprises a mixture of water and a resin formed from a homopolymer or a copolymer of polyacrylic acid and a polyol and being present in the finished dry mat in amounts between about 15 and about 25 wt. percent based on the weight of the dry mat, and iii) the fibrous nonwoven mat having a basis weight of about 2.3 to about 2.6 pounds per 100 square feet, a thickness of about 42+/−3 mils, a wet tensile strength of at least 35 percent of the dry tensile strength, a Tabor stiffness of at least about 40, an air permeability in the range of about 500 to about 800CFM/sq. ft and passing the flammability test of NFPA, Method #701.

17. The method according to claim 16 wherein the polyester fibers are about 0.25 inch long.

18. The method according to claim 17 wherein the polyester fibers comprise about 8 to about 16 wt. percent of the fibers.

19. The method according to claim 18 wherein the denier of the polyester fibers is at least 1.5.

20. The method according to claim 19 wherein the glass fibers are between about 0.5 and 1.5 inches long.

21. The method according to claim 20 wherein the average fiber diameter of the glass fibers is between about 14.5 microns and about 17 microns and the length is between about 0.7 and about 1.1 inch.

22. The method according to claim 21 wherein the average molecular weight of the polyacrylic acid polymer is about 3,000 or less.

23. The method according to claim 21, wherein the polyol is triethanolamine.

24. The method according to claim 20, wherein the average molecular weight of the polyacrylic acid polymer is about 3,000 or less.

25. The method according to claim 20, wherein the polyol is triethanolamine.

26. The method according to claim 19, wherein the average molecular weight of the polyacrylic acid polymer is about 3,000 or less.

27. The method according to claim 19, wherein the polyol is triethanolamine.

28. The method according to claim 18, wherein the average molecular weight of the polyacrylic acid polymer is about 3,000 or less.

29. The method according to claim 28 wherein the polyester fibers are at least 0.25 inch long and at least 1.5 denier.

30. The method according to claim 29 wherein the glass fibers are between about 0.5 and 1.5 inches long and have an average diameter of between about 14.5 and about 17 microns.

31. The method according to claim 30, wherein the polyol is triethanolamine.

32. The method according to claim 29 wherein the glass fibers have an average diameter between about 13 microns and about 16 microns and a length of between about 0.75 and about 1.1 inch.

33. The method according to claim 32, wherein the average molecular weight of the polyacrylic acid polymer is about 2,000 or less.

34. The method according to claim 32, wherein the polyol is triethanolamine.

35. The method according to claim 29, wherein the average molecular weight of the polyacrylic acid polymer is about 2,000 or less.

36. The method according to claim 29, wherein the polyol is triethanolamine.

37. The method according to claim 18, wherein the polyol is triethanolamine.

38. The method according to claim 17, wherein the average molecular weight of the polyacrylic acid polymer is about 3,000 or less.

39. The method according to claim 38 wherein the fibers comprise about 8 to about 16 wt. percent polyester fibers.

40. The method according to claim 39, wherein the average molecular weight of the polyacrylic acid polymer is about 2,000 or less.

41. The method according to claim 39, wherein the polyol is triethanolamine.

42. The method according to claim 17, wherein the polyol is triethanolamine.

43. The method according to claim 16, wherein the average molecular weight of the polyacrylic acid polymer is about 3,000 or less and the tensile strength in the machine direction of the mat is about 90 lbs. per 3 inch width of the mat.

44. The method according to claim 43, wherein the polyol is triethanolamine.

45. The method according to claim 43 wherein the polymer fibers are polyester fibers are at least 0.25 inch long and about 1.5 denier.

46. The method according to claim 45, wherein the average molecular weight of the polyacrylic acid polymer is about 2,000 or less.

47. The method according to claim 46, wherein the polyol is triethanolamine.

48. The method according to claim 45, wherein the average molecular weight of the polyacrylic acid polymer is about 2,000 or less.

49. The method according to claim 45, wherein the polyol is triethanolamine.

50. The method according to claim 16, wherein the polyol is triethanolamine.

51. A method for making a fibrous nonwoven mat facer suitable as a backer mat, connector sheet, in a compressible ceiling panel of the type described in U.S. Published Patent Application No. 20020002142, filed Apr. 23, 2001, comprising;

a) dispersing fibers comprising two different types of fibers in an aqueous dispersion, b) draining said dispersion through a moving forming screen to form a wet fibrous web, c) applying an aqueous resin binder to the wet web and removing excess binder to produce the desired binder content in the wet web, and d) drying the wet web and curing the resin in the binder to a "B" stage condition to form a thermoformable fibrous nonwoven mat, wherein;

i) the fiber dispersion comprises about 2 to about 35 weight percent polymer fibers selected from a group consisting of polyester, polypropylene, nylon, PBT, polyacrynitrile and polybenzimidizole and about 90 to about 65 weight percent glass fibers, based on the total weight of the fibers in the dispersion, ii) the aqueous binder comprises a mixture of water and a resin formed from a homopolymer or a copolymer of polyacrylic acid and a polyol, and iii) after thermoforming the "B staged" mat to a desired shape and curing the shape the fibrous nonwoven mat in the desired shape having the properties of a basis weight of about 2.3 to about 2.6pounds per 100 square feet, a thickness of about 42+/−3 mils, a wet tensile strength of at least 35 percent of the dry tensile strength, a Tabor stiffness of at least about 40, an air permeability in the range of about 500 to about 800 CFM/sq. ft. and passing the flammability.

52. The method of claim 51 wherein the average molecular weight of the polyacrylic acid polymer is about 3000 or less.

53. The mat of claim 52 wherein the polyol is triethanolamine.

54. The mat of claim 52 wherein the polyol is triethanolamine.

* * * * *

UNITED STATES PATENT AND TRADEMARK OFFICE

CERTIFICATE OF CORRECTION

PATENT NO. : 8,758,563 B2
APPLICATION NO. : 13/599142
DATED : June 24, 2014
INVENTOR(S) : Alan Michael Jaffee and Richard Emil Kajander It is certified that error appears in the above-identified patent and that said Letters Patent is hereby corrected as shown below:

In the Claims:

Column 12, line 33, “mat” should read --method--.

Column 12, line 35, “mat” should read --method--.

Signed and Sealed this
Second Day of September, 2014

Michelle K. Lee

Michelle K. Lee
*Deputy Director of the United States Patent and Trademark Office*